US011666797B2

(12) United States Patent
Yeh

(10) Patent No.: US 11,666,797 B2
(45) Date of Patent: Jun. 6, 2023

(54) DRAG GAIN STRUCTURE FOR GRAVITY WHEEL OF FITNESS EQUIPMENTS

(71) Applicant: Yung-Sung Yeh, New Taipei (TW)

(72) Inventor: Yung-Sung Yeh, New Taipei (TW)

( * ) Notice: Subject to any disclaimer, the term of this patent is extended or adjusted under 35 U.S.C. 154(b) by 12 days.

(21) Appl. No.: 17/337,627

(22) Filed: Jun. 3, 2021

(65) Prior Publication Data

US 2021/0283456 A1 Sep. 16, 2021

Related U.S. Application Data

(63) Continuation-in-part of application No. 16/268,934, filed on Feb. 6, 2019, now abandoned.

(51) Int. Cl.
*A63B 21/22* (2006.01)
*A63B 21/00* (2006.01)
*A63B 22/06* (2006.01)

(52) U.S. Cl.
CPC ..... *A63B 21/225* (2013.01); *A63B 21/15* (2013.01); *A63B 22/0605* (2013.01)

(58) Field of Classification Search
CPC ..... A63B 22/0605; A63B 21/0053; A63B 21/015; A63B 21/008; A63B 23/0476; A63B 69/16; A63B 21/005–0053; A63B 21/0056–0059; A63B 21/012–015; A63B 21/157; A63B 21/22–227; A63B 21/4049; A63B 22/06–2022; A63B 22/0694; A63B 23/035–0355; A63B 21/225; A63B 21/159; A63B 21/15; A63B 2022/0623
See application file for complete search history.

(56) References Cited

U.S. PATENT DOCUMENTS 4,208,921 A * 6/1980 Keyes ..... B60K 6/105 74/572.1
2005/0221962 A1* 10/2005 Warner ..... F16D 41/24 482/57
2013/0074646 A1* 3/2013 Yeh ..... A63B 21/015 74/572.21

FOREIGN PATENT DOCUMENTS

TW M479782 * 6/2014 ..... A63B 23/04
TW 201713387 * 4/2017 ..... A63B 21/015

OTHER PUBLICATIONS

English translation of TW201713387 derived from Espacenet (Year: 2017).*

(Continued)

*Primary Examiner* — Joshua Lee
*Assistant Examiner* — Catrina A Letterman
(74) *Attorney, Agent, or Firm* — Egbert, McDaniel & Swartz, PLLC

(57) ABSTRACT

A drag gain structure for the gravity wheel of fitness equipment includes an eccentric driving member disposed on the first side of the gravity wheel, which includes inner and outer side plate sections, and an interconnecting piece. The interconnecting piece is rotationally coupled to at least one of the plate sections. One end of outer side plate section is fitted over and fixed to the shaft, and one end of inner side plate section is connected to an eccentric position of gravity wheel through the first bias joint pin. A bearing pedestal is disposed on the second side of the gravity wheel, including a bearing screwed on the shaft, a pedestal shell fitted over the bearing and a radial protruding plate on the periphery of pedestal shell. The protruding end of the radial protruding plate is connected to an eccentric position of gravity wheel through the second bias joint pin.

4 Claims, 5 Drawing Sheets

(56) References Cited

OTHER PUBLICATIONS

English translation of TWM479782 derived from Google Patents (Year: 2014).*

* cited by examiner

DRAG GAIN STRUCTURE FOR GRAVITY WHEEL OF FITNESS EQUIPMENTS

CROSS-REFERENCE TO RELATED U.S. APPLICATIONS

The present application is a continuation-in-part of U.S. application Ser. No. 16/268,934, filed on Feb. 6, 2019, presently pending.

BACKGROUND OF THE INVENTION

1. Field of the Invention

The present invention relates generally to a local structure of fitness equipment, and more particularly to a drag gain structure for the gravity wheel of fitness equipment which discloses an innovative type.

2. Description of Related Art Including Information Disclosed Under 37 CFR 1.97 and 37 CFR 1.98

In the existing design of exercise equipment structure types, to enable the operator to obtain a certain drag effect during exercise for a better exercise effect, a gravity wheel (also known as counterweight wheel or flywheel) is usually provided. The gravity wheel is connected to the mechanism which is crank or pedal driven by the operator's force. In order to implement better drag effect under the condition of minimum outside diameter of gravity wheel, the known practice usually uses the structure type of belt pulley block variable-speed gear to increase the drag effect, or arranges an electrically controlled magnetic drag regulator to adjust and control the drag.

Under the constraint that various specifications (e.g. outside diameter, wheel width and weight) of the gravity wheel cannot be increased anymore, the maximum drag effect the known exercise equipments can implement through the aforesaid belt pulley block and electrically controlled magnetic drag regulator is supposed to reach a bottleneck, it is difficult to make significant progress.

Furthermore, said belt pulley block results in problems and defects in the overall structure of exercise equipment, such as occupying too much space and increasing the component material cost and assembly cost greatly.

BRIEF SUMMARY OF THE INVENTION

The primary objective of the present invention is to provide a drag gain structure for the gravity wheel of fitness equipment. Said gravity wheel is to be installed in a position of a shaft of a fitness equipment, two ends of the shaft are to be driven by the preset power source to rotate, the gravity wheel includes a first side and a second side.

The technical characteristic of problem solving of the present invention is that said drag gain structure includes:

an eccentric driving member, disposed on the first side of the gravity wheel, the eccentric driving member includes an outer side plate section, an inner side plate section and an interconnecting piece located between the outer side plate section and inner side plate section, the outer side plate section has a fixed end and an extension end, the inner side plate section has a first coupling end and a second coupling end, the interconnecting piece is rotationally coupled to at least one of the extension end and the second coupling end, wherein the fixed end of the outer side plate section is formed with a coupling hole fitted over and fixed to the periphery of the shaft, so that the outer side plate section is linked with the shaft, the first coupling end of the inner side plate section is connected to an eccentric position of the gravity wheel by a first bias joint pin, there is a pitch between the inner side plate section and the first side of the gravity wheel, a first avoidance hole is formed between the first coupling end and the second coupling end of the inner side plate section, the first avoidance hole allows the shaft to pass through in loose fit state; forming the configuration that the first bias joint pin and the interconnecting piece of the eccentric driving member are in the radial direction of the shaft and far from two sides;

a bearing pedestal, disposed on the second side of the gravity wheel and screwed on the periphery of the shaft, there is an axial spacing between the bearing pedestal and the gravity wheel, the bearing pedestal includes more than one bearing, a pedestal shell fitted over the periphery of the bearing and a radial protruding plate on the periphery of the pedestal shell, wherein the bearing is screwed on the periphery of the shaft, the protruding end of the radial protruding plate is connected to an eccentric position of the gravity wheel through the second bias joint pin, the radial protruding plate is connected to the end of the second bias joint pin, there is a pitch to the second side of the gravity wheel;

wherein a second avoidance hole is arranged in the center of the gravity wheel for the shaft to pass through in loose fit state, forming the indirect transmission of simultaneous motion of the gravity wheel and the bearing pedestal connected only by the second bias joint pin;

wherein the second bias joint pin and the first bias joint pin are disposed in the eccentric positions in different directions of the gravity wheel, so that the second bias joint pin and the first bias joint pin are interlaced.

In terms of main effect and merits of the present invention, the driving drag can be increased by eccentric drive and non-direct transmission, the space volume, material and assembly costs of the drag structure for the gravity wheel of fitness equipments are reduced greatly, implementing better economic benefit of industry and practical progressiveness.

Moreover, based on the feature of rotary connection of the zigzag transmission structure formed of the inner side plate section, outer side plate section and interconnecting piece instead of integrated positive drive state, the acting force transmission position of the arbor in relation to the wheel body is in the outside diameter of arbor, so that the actuation drag value of the present invention is much larger than the original case.

DETAILED DESCRIPTION OF THE INVENTION

Figure 1:
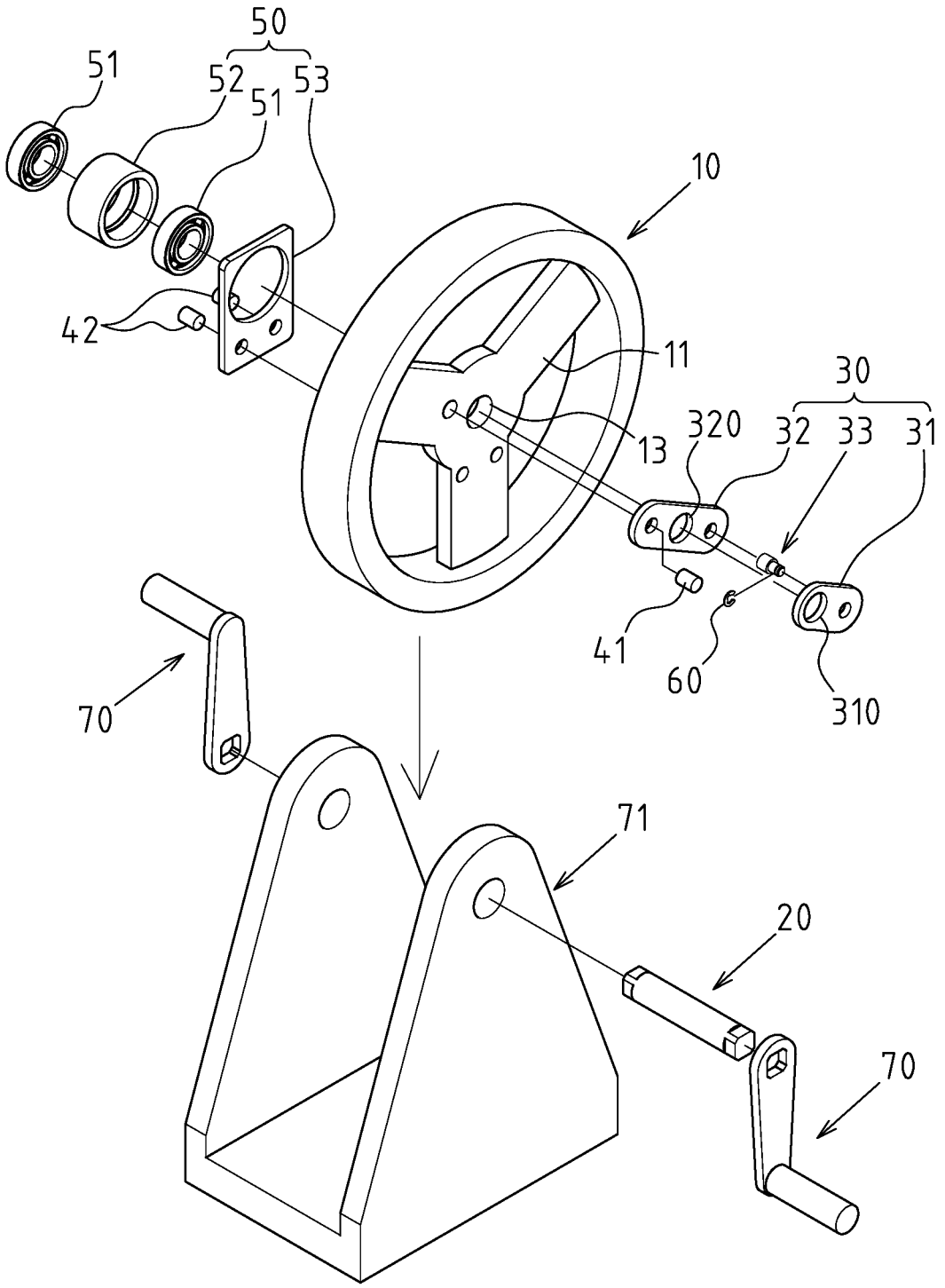
FIG. 1 is an exploded view of the preferred embodiment of the present invention.

FIGS. 1 to 5 show the preferred embodiments of the drag gain structure for the gravity wheel of fitness equipments of the present invention, but these embodiments are for illustration only, the patent application is not limited to this structure; The gravity wheel 10 is to be installed on a shaft 20 of a fitness equipment, two ends of the shaft 20 are to be driven by the preset power source (e.g. pedal crank components) to rotate. The gravity wheel 10 includes a first side 11 and a second side 12.

Said drag gain structure comprises the following components: an eccentric driving member 30, disposed on the first side 11 of the gravity wheel 10, the eccentric driving member 30 includes an outer side plate section 31, an inner side plate section 32 and an interconnecting piece 33 located between the same ends of the outer side plate section 31 and inner side plate section 32, the outer side plate section 31 has a fixed end 311 and an extension end 312, the inner side plate section 32 has a first coupling end 321 and a second coupling end 322, the interconnecting piece 33 is rotationally coupled to at least one of the extension end 312 and the second coupling end 322, wherein the fixed end 311 of the outer side plate section 31 is formed with a coupling hole 313, fitted over and fixed to the periphery of the shaft 20, so that the outer side plate section 31 is linked with the shaft 20. The first coupling end 321 of the inner side plate section 32 is connected to an eccentric position of the gravity wheel 10 through a first bias joint pin 41, there is a pitch between the inner side plate section 32 and the first side 11 of the gravity wheel 10, a first avoidance hole 320 is formed between the first coupling end 321 and the second coupling end 322 of the inner side plate section 32, the first avoidance hole 320 lets the shaft 20 pass through in loose fit state (note: the shaft 20 does not contact the first avoidance hole 320); forming the configuration that the first bias joint pin 41 and the interconnecting piece 33 of the eccentric driving member 30 are in radial direction of the shaft 20 and far from both sides; a bearing pedestal 50, disposed on the second side 12 of the gravity wheel 10 and screwed on the periphery of the shaft 20, there is an axial spacing 60 between the bearing pedestal 50 and the gravity wheel 10 (only indicated in FIG. 3), the bearing pedestal 50 includes more than one bearing 51, a pedestal shell 52 fitted over the periphery of the bearing 51 and a radial protruding plate 53 on the periphery of the pedestal shell 52, wherein the bearing 51 is screwed on the periphery of the shaft 20, the protruding end of the radial protruding plate 53 is connected to an eccentric position of the gravity wheel 10 through a second bias joint pin 42, the radial protruding plate 53 is connected to the end of the second bias joint pin 42, there is a pitch to the second side 12 of the gravity wheel 10.

Figure 2:
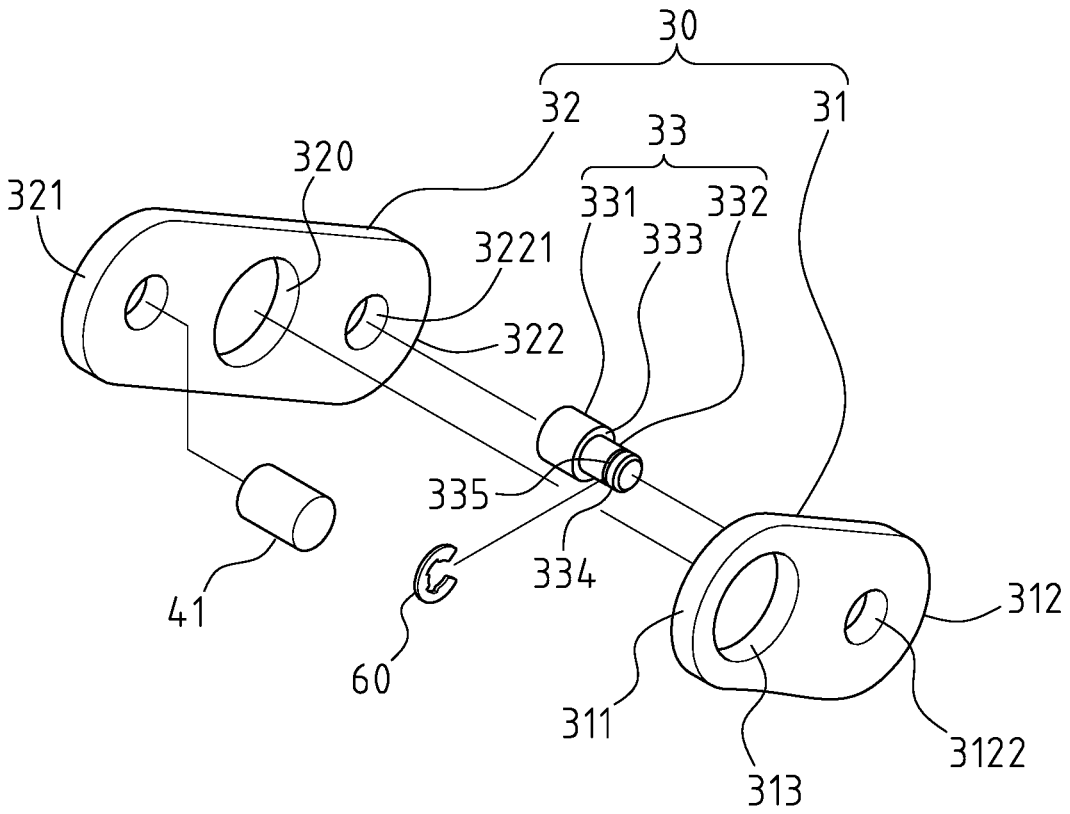
FIG. 2 is an enlarged view of partial components in FIG. 1.
Figure 3:
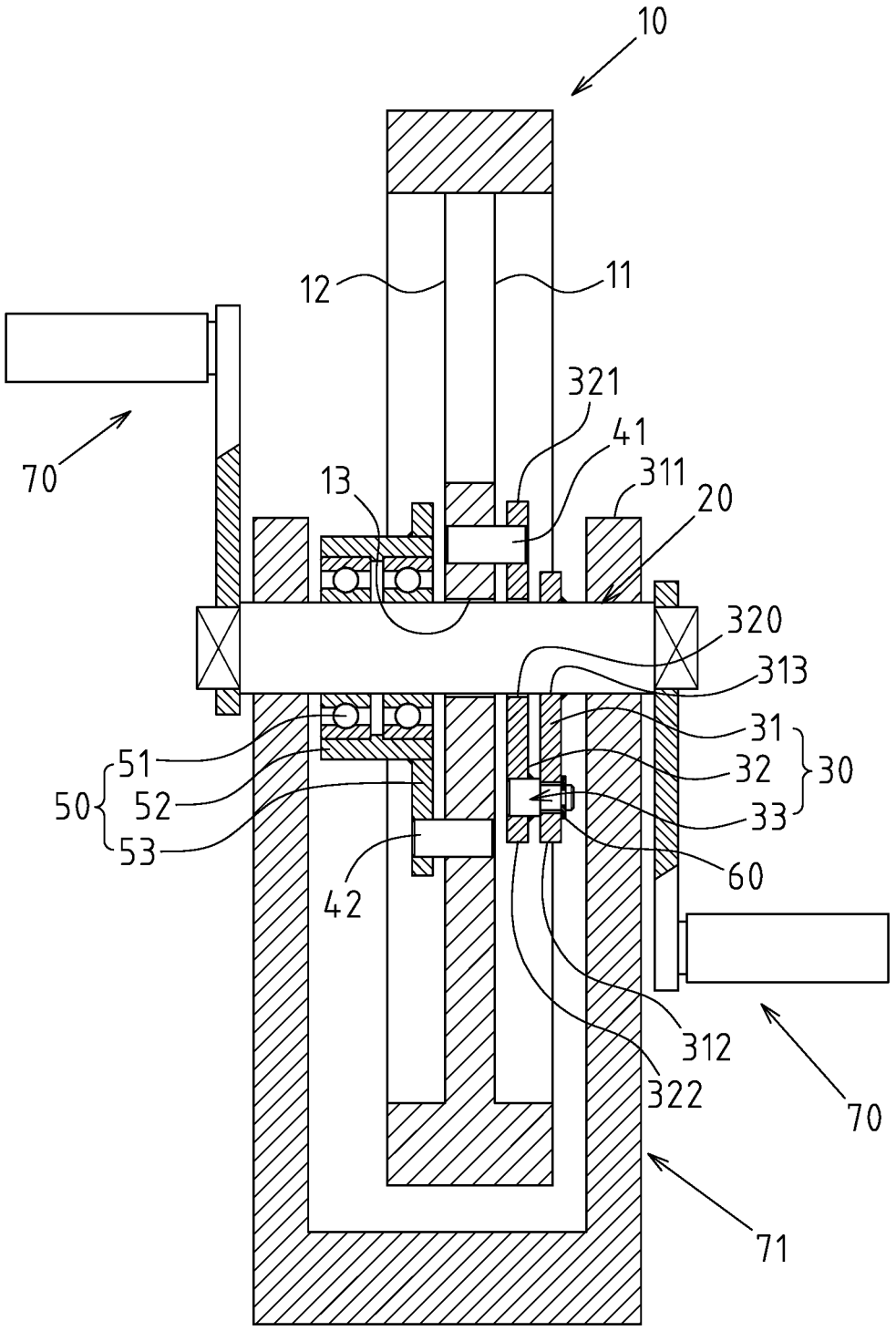
FIG. 3 is a longitudinal section view of combined state in the preferred embodiment of the present invention.
Figure 4:
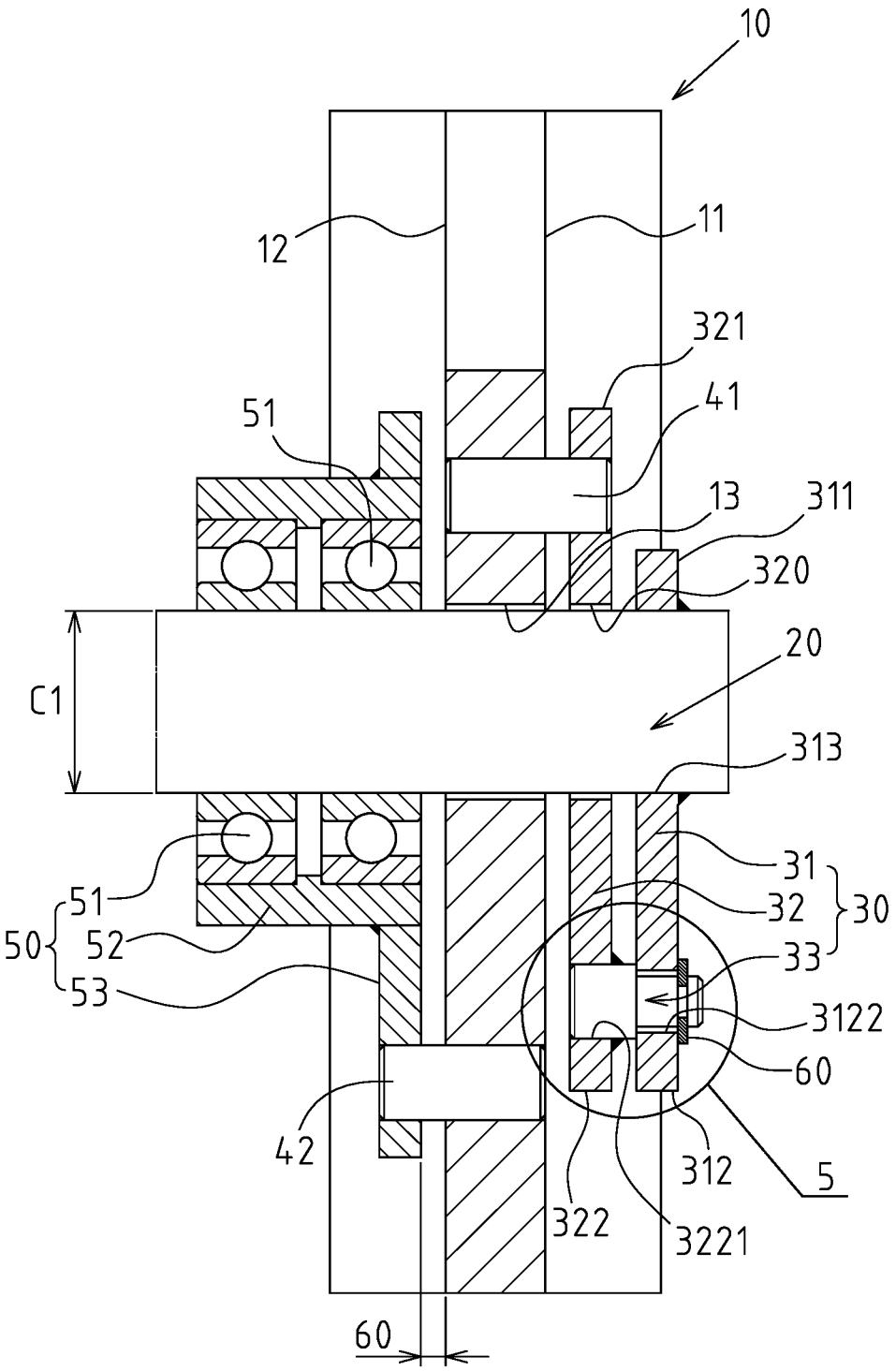
FIG. 4 is an enlarged view of partial components in FIG. 3.
Figure 5:
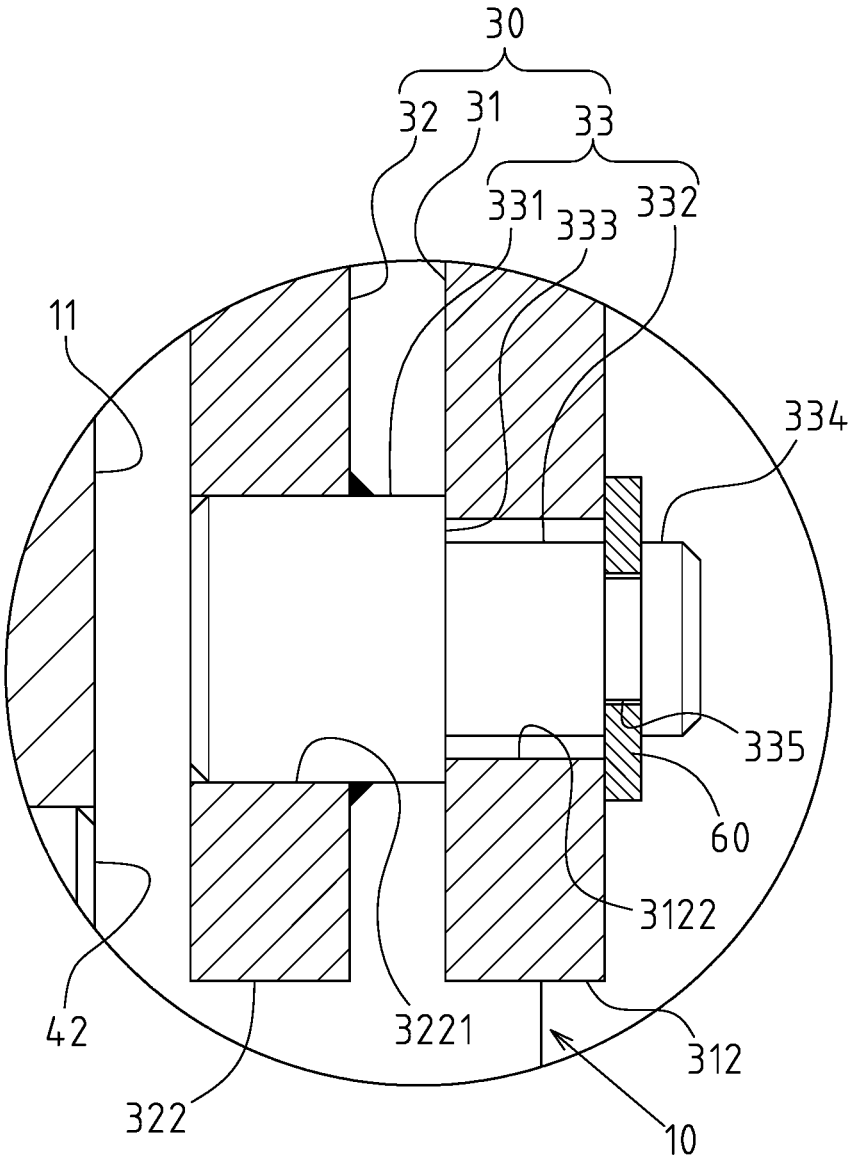
FIG. 5 an enlarged view of Mark 5 in FIG. 4.

As shown in FIG. 1 to FIG. 3, in this case, the second bias joint pin 42 and the first bias joint pin 41 are located in the eccentric positions in different directions of the gravity wheel 10 respectively, so that the second bias joint pin 42 and the first bias joint pin 41 are interlaced; wherein a second avoidance hole 13 is arranged in the center of the gravity wheel 10 for the shaft 20 to pass through in loose fit state (note: the shaft 20 does not contact the second avoidance hole), forming the indirect transmission of simultaneous motion of the gravity wheel 10 and the bearing pedestal 50 connected only by the second bias joint pin 42.

As shown in FIG. 1 to FIG. 3, in this case, the interconnecting piece 33 is rotationally coupled to the extension end 312, the interconnecting piece 33 is fixed to the second coupling end 322; the interconnecting piece 33 of the eccentric driving member 30 is a first order radial cylinder, defining a first hole part 331, a second hole part 332 and an annular shoulder 333 between the first hole part 331 and the second hole part 332, the second coupling end 322 is formed with a first circular hole 3221 for fixing the first hole part 331, the extension end 312 is formed with a second circular hole 3122 for the second hole part 332 to pass through in loose fit state, and the second hole part 332 passes through the second circular hole 3122 to form a projecting part 334, the projecting part 334 uses a limiting component 60 to limit the relative relationship between the outer side plate section 31 and the second hole part 332.

Wherein the limiting component 60 is a retaining ring, and the projecting part 334 is formed with a ring groove 35 for buckling the retaining ring-shaped limiting component 60.

Additionally, the limiting component 60 can be a butterfly pin (not shown in the figure).

As stated above, the interconnecting piece 33 can be rotationally coupled only to the inner side plate section 32; or the interconnecting piece 33 can be rotationally coupled to the outer side plate section 31 and the inner side plate section 32, these embodiments are apparently the variable patterns which can be easily known by the persons with general knowledge of this technical field according to said implementation, so they will not be stated one by one.

Based on said structural composition type and technical characteristics, the drag gain structure for the gravity wheel of fitness equipments disclosed in the present invention can be used as the drag structure for the existing exercise equipments, such as pedaled exercise bikes, elliptic stair steppers and so on. This part is as the implementation pattern shown in FIGS. 1 and 2 where the two ends of shaft 20 are provided with a pedal crank component 70 as the power source, and the shaft 20 can be screwed on the structure of a supporter 71 of fitness equipment. The structure type design of the present invention gains the driving drag by such innovative and simple technical features as said eccentric driving member 30 and bearing pedestal 50. In terms of the eccentric driving member 30, when the user pedals the pedal crank component 70 to rotate the shaft 20, not driving the gravity wheel 10 directly to rotate, the outer side plate section 31 is driven through the coupling hole 310, and then the interconnecting piece 33 is linked with the inner side plate section 32. The inner side plate section 32 drives the eccentric position of the gravity wheel 10 through the first bias joint pin 41, the zigzag drive path of the eccentric driving member 30 enhances the drag sense when the user applies force to drive the gravity wheel 10 to rotate. This principle is simple, the indirect transmission form takes more strength than direct transmission form. Therefore, the drag sense in driving the gravity wheel 10 to rotate can be enhanced without increasing the outside diameter and width of the gravity wheel 10. Said eccentric driving member 30 can be formed by simple plate and cylinder components, simple structure, convenient assembly, and small size, the fitness equipment manufacturing cost can be reduced considerably. In terms of driving torque of the gravity wheel 10, the eccentric driving member 30 disclosed in the present invention drives the gravity wheel 10 through the first bias joint pin 41, the link point is located in the eccentric position of gravity wheel 10, in comparison to the known direct link with the shaft, the reflexed extension structure and eccentric link structure of eccentric driving member 30 have significantly multiplicative twisting force arm, so once the gravity wheel 10 is rotated to generate inertia, the generated inertia and centrifugal force are larger than that known.

To be more specific, the interconnecting piece 33 of the unique reflexed section in the present invention is rotationally coupled to at least one of the outer side plate section 31 and inner side plate section 32, meaning the zigzag transmission structure formed of the inner side plate section 32, outer side plate section 31 and interconnecting piece 33 in this project is not in integrated positive drive state, so the acting force transmission position of arbor 20 in relation to the wheel body 10 returns from the interconnecting piece 33 in the original project to the joint of outer side plate section 31 and arbor 20, i.e. the outside diameter C1 of arbor 20 (indicated in FIG. 4), because it is the weld joint of outer side plate section 31 and arbor 20. If the diameter of wheel body 10 in the present invention is set as 260 mm, the weight of wheel body 10 is set as 6 kg, the diameter of arbor 20 is set as 17 mm, and the maximum outside diameter of circular motion path of pedal crank 70 is set as 300 mm, which are calculated as follows:

260 (diameter of wheel body)÷17 (actual transmission point of axis)=15.3 (torque ratio 1)

260 (diameter of wheel body)÷300 (outside diameter of crank circulation)=0.86 (torque ratio 2)

15.3 (torque ratio 1)×0.86 (torque ratio 2)=13.2 (total torque ratio)

6 kg (weight of wheel body)×13.2 (total torque ratio)=79.2 kg (actuation drag value)

According to said calculation results, the actuation drag value resulted from the technical features of this project is 79.2 kg (note: the actuation drag value of the original project is about 6 kg); which is to say, the drag efficiency of this project is over 10 times of the original project, so the technical effect of the technical features of the present invention is not foreseeable or apparent to the known technology. Therefore, in comparison to the known technology, this project can achieve economic benefit, including simplified components and lower cost, and can avoid the reduction of drag sense, so as to achieve such effects as "increasing the drag sense and difficulty when the user drives the gravity wheel to rotate".

I claim:

1. A drag gain assembly for a piece of fitness equipment, the drag gain assembly comprising:

a gravity wheel positioned on a shaft of the piece of fitness equipment, the shaft having opposite ends adapted to be driven in rotation by a power source, said gravity wheel having a first side and a second side;

an eccentric driving member disposed on the first side of said gravity wheel, said eccentric driving member having an outer side plate section and an inner side plate section and an interconnecting piece located between the outer side plate section and the inner side plate section, the outer side plate section having a fixed end and an extension end, the inner side plate section having a first coupling end and a second coupling end, the interconnecting piece being rotationally coupled to at least one of the extension end and the second coupling end, wherein the fixed end of the outer side plate section has a coupling hole fitted over and fixed to a periphery of the shaft such that the outer side plate section is linked to the shaft, the first coupling end of the inner side plate section being connected to an eccentric position of said gravity wheel by a first bias joint pin, wherein a pitch is formed between the inner side plate section and the first side of said gravity wheel, wherein a first avoidance hole is formed between the first coupling end and the second coupling end of the inner side plate section, wherein the shaft is adapted to pass loosely through the first avoidance hole such that the first bias joint pin and the interconnecting piece of said eccentric driving member are in opposite radial directions with respect to the shaft; and a bearing pedestal disposed on the second side of said gravity wheel and adapted to be screwed onto a periphery of the shaft, said bearing pedestal and said gravity wheel having an axial spacing therebetween, said bearing pedestal having at least one bearing and a pedestal shell fitted over a periphery of the at least one bearing, the pedestal shell having a radial protruding plate at a periphery thereof, the at least one bearing being adapted to be screwed onto the periphery of the shaft, the radial protruding plate having a protruding end being connected to the eccentric position of said gravity wheel through a second bias joint pin, wherein the radial protruding plate is connected to an end of the second bias joint pin such that the second side of said gravity wheel has a pitch, wherein a second avoidance hole is formed at a center of said gravity wheel, the second avoidance hole being adapted to allow the shaft to pass loosely therethrough so as to indirectly transmit simultaneous motion of said gravity wheel and said bearing pedestal connected only by the second bias joint pin, wherein the second bias joint pin and the first bias joint pin are disposed in eccentric positions in different directions of said gravity wheel.

2. The drag gain assembly of claim 1, wherein the interconnecting piece is rotationally coupled to the extension end, the interconnecting piece being fixed to the second coupling end.

3. The drag gain assembly of claim 2, wherein the interconnecting piece of said eccentric driving member is a first order radial cylinder that defines a first hole part and a second hole part and an annular shoulder between the first hole part and the second hole part, the second coupling end having a first circular hole fixing the first hole part, the extension end being formed with a second circular hole, the second hole part passing loosely through the second circular hole, the second hole part extending through the second circular hole so as to form a projecting part, wherein the projecting part has a limiting component that limits a relative relationship between the outer side plate section and the second hole part.

4. The drag gain assembly of claim 3, wherein the limiting component is a retaining ring, the projecting part having a ring groove receiving the retaining ring.

* * * * *